US008427063B2

(12) United States Patent
Hulett

(10) Patent No.: US 8,427,063 B2
(45) Date of Patent: Apr. 23, 2013

(54) MULTICOLOR LED SEQUENCER

(75) Inventor: Jeffery Neil Hulett, Encinitas, CA (US)

(73) Assignee: Vektrex Electronic Systems, Inc., San Diego, CA (US)

( * ) Notice: Subject to any disclaimer, the term of this patent is extended or adjusted under 35 U.S.C. 154(b) by 191 days.

(21) Appl. No.: 12/840,454

(22) Filed: Jul. 21, 2010

(65) Prior Publication Data

US 2011/0025215 A1 Feb. 3, 2011

Related U.S. Application Data

(60) Provisional application No. 61/271,954, filed on Jul. 29, 2009.

(51) Int. Cl.
*H05B 41/00* (2006.01)

(52) U.S. Cl.
USPC ..... 315/185 R; 315/291; 315/312; 315/307

(58) Field of Classification Search ..... 315/291, 315/312, 307, 294, 121, 185 R, 169.3; 345/87, 345/88, 82, 102
See application file for complete search history.

(56) References Cited

U.S. PATENT DOCUMENTS

| | | | | |
|---|---|---|---|---|
| 4,705,406 | A * | 11/1987 | Havel | 368/10 |
| 6,217,188 | B1 * | 4/2001 | Wainwright et al. | 362/103 |
| 7,178,971 | B2 | 2/2007 | Pong et al. | |
| 7,186,000 | B2 | 3/2007 | Lebens | |
| 7,317,403 | B2 * | 1/2008 | Grootes et al. | 340/815.45 |
| 7,372,430 | B2 | 5/2008 | Shinohara | |
| 7,439,945 | B1 | 10/2008 | Awalt | |
| 7,465,056 | B2 | 12/2008 | Peng | |
| 7,508,141 | B2 | 3/2009 | Wong | |
| 7,649,326 | B2 * | 1/2010 | Johnson et al. | 315/291 |
| 7,719,208 | B2 * | 5/2010 | Li et al. | 315/307 |
| 2004/0041781 | A1 * | 3/2004 | Sato et al. | 345/102 |
| 2005/0243022 | A1 | 11/2005 | Negru | |
| 2005/0269580 | A1 * | 12/2005 | D'Angelo | 257/88 |
| 2006/0012313 | A1 | 1/2006 | Weng | |
| 2006/0232219 | A1 | 10/2006 | Xu | |
| 2007/0024213 | A1 | 2/2007 | Shteynberg et al. | |
| 2007/0182676 | A1 | 8/2007 | Sinyugin | |
| 2008/0116818 | A1 | 5/2008 | Shteynberg et al. | |
| 2009/0066261 | A1 | 3/2009 | Liu | |
| 2009/0174343 | A1 | 7/2009 | Lenz et al. | |
| 2009/0195189 | A1 | 8/2009 | Zampini | |

FOREIGN PATENT DOCUMENTS

WO 2008052293 5/2008

OTHER PUBLICATIONS

International Search Report for International App No. PCT/US2010/043245, completed Oct. 20, 2010.

* cited by examiner

*Primary Examiner* — Vibol Tan
(74) *Attorney, Agent, or Firm* — Sheppard Mullin Richter & Hampton LLP

(57) ABSTRACT

A multicolored LED luminaire module is provided that can be controlled using a single driver and only two wires. The LED luminaire module comprises a plurality of LEDs and a sequencer. The sequencer connects each LED to the circuit in a predetermined order. Synchronously with the sequencer, the driver transmits a control signal comprising a time division multiplexed (TDM) signal that combines the driving currents for each LED into one TDM signal. The sequencer and TDM rate are sufficiently fast such that the light emitted by the LED luminaire appears to be the combined light from all the LEDs.

26 Claims, 12 Drawing Sheets

MULTICOLOR LED SEQUENCER

CROSS-REFERENCE TO RELATED APPLICATIONS

This application claims the benefit of U.S. Provisional Application No. 61/271,954 filed Jul. 29, 2009.

TECHNICAL

The present invention relates generally to light emitting diodes LEDs), and more particularly, some embodiments relate driving systems for LED lighting systems.

DESCRIPTION OF THE RELATED ART

Some LED-based luminaires provide white light by mixing from a plurality of monochromatic LEDs. Such multicolor LEDs may utilize two, three, four, or more different colors of monochromatic LEDs. White light, and even other colors of light, is provided by modifying the relative outputs of the various monochromatic LEDs. Typically, these multicolor LED-based color luminaires often utilize three color LED modules which have red, green, and blue LEDs. FIG. 1 illustrates such a system. A three color LED module 100 comprises a red LED 103, a green LED 102, and a blue LED 101. Three separate drivers, a blue LED driver 104, a green LED driver 105, and a red LEI) driver 106 control the relative outputs of LEDs 101, 102, and 103, respectively.

In the illustrated system, each driver utilizes a pair of wires 108 and 109, 110 and 110, or 112 and 113, to control its respective LED. Accordingly, the wire 107 used to connect the drivers to the module 100 requires a total of six wires. In some systems, a common anode or common cathode wire is used to reduce this total to four wires.

BRIEF SUMMARY OF EMBODIMENTS OF THE INVENTION

According to various embodiments of the invention, a multicolored LED luminaire module is provided that can be controlled using a single driver and only two wires. The LED luminaire module comprises a plurality of LEDs and a sequencer. The sequencer connects each LED to the circuit in a predetermined order. Synchronously with the sequencer, the driver transmits a control signal comprising a time division multiplexed (TDM) signal that combines the driving currents for each LED into one TDM signal. The sequencer and TDM rate are sufficiently fast such that the light emitted by the LED luminaire appears to be the combined light from all the LEDs.

According to an embodiment of the invention, a multicolor light emitting diode (LED) lighting system, comprises an LED module comprising a plurality of LEDs, and a sequencer electrically coupled to the plurality of LEDs configured to connect LEDs of the plurality to a circuit and isolate other LEDs of the plurality from the circuit in a predetermined sequence; and a driver electrically coupled to the circuit and configured to provide a driving signal to the plurality of LEDs according to the predetermined sequence and in synchronization with the sequencer.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth scope, or applicability of the invention. It should be noted that for clarity and ease of illustration these drawings are not necessarily made to scale.

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE EMBODIMENTS OF THE INVENTION

The present invention is directed toward an LED-based illumination system. Use of time division multiplexing allows a multi-color LED luminaire to be operated using a single driver and a single pair of wires.

Figure 1:
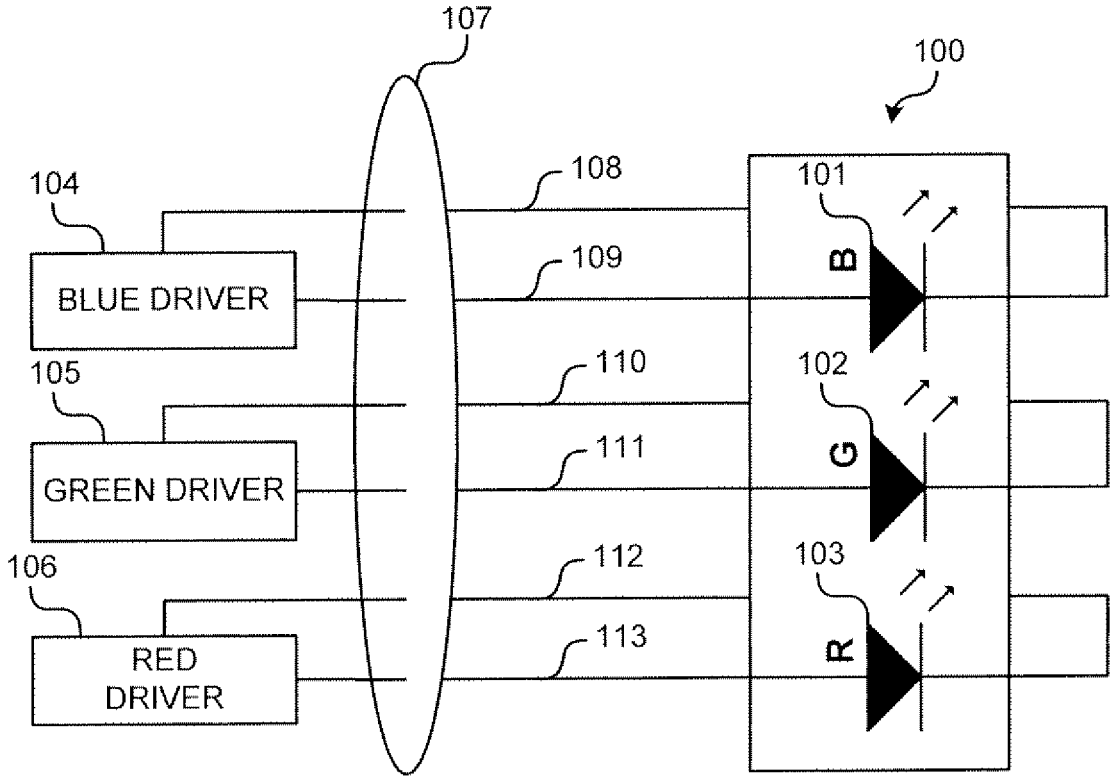
Fig. 1 Prior Art
FIG. 1 illustrates a prior art multicolor LED that requires separate drivers for each color LED.
Figure 2:
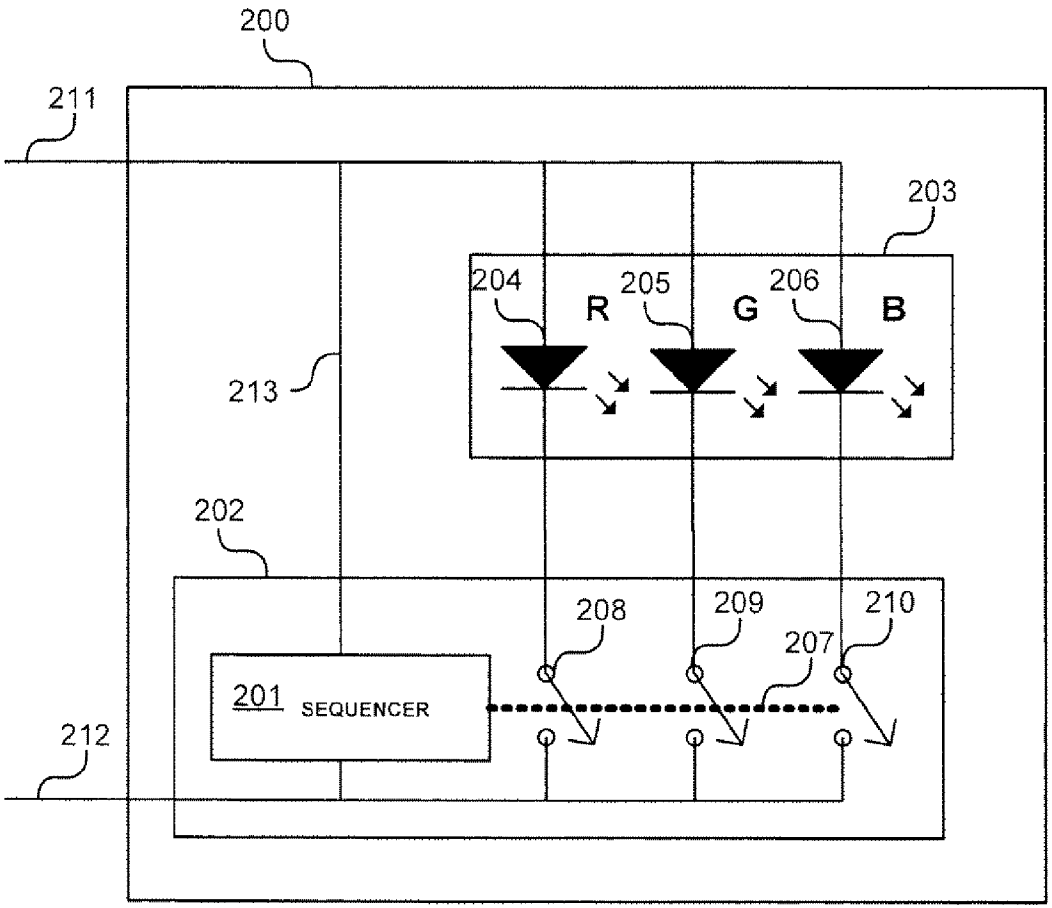
FIG. 2 illustrates an LED module implemented in accordance with an embodiment of the invention

FIG. 2 illustrates an LED module implemented in accordance with an embodiment of the invention. LED module 200 comprises a plurality of LEDs 203, sufficient to span a predetermined color space. In the illustrated embodiment, a red LED 204, a green LED 205, and a blue LED 206 allow color mixing to form white light or other colored light, such as purple, yellow, etc. . . . In other embodiments, dichromatic, tetrachromatic, or larger numbers of colors may be employed.

A sequencer module 202 sequentially connects and disconnects individual LEDs of the plurality 203 to the circuit. In the illustrated embodiment, the sequence module 202 comprises a sequencer control module 201 that controls 207 a plurality of switches 208, 209, 210. Each switch is electrically coupled to an individual LED. By connecting and disconnecting the switches, the sequencer connects and disconnects LEDs to the leads 211 and 212. For example, by connecting switch 208 and disconnecting switches 209 and 210 the red LED 204 is coupled to the leads 211 and 212, and the green LED 205 and the blue LED 206 are isolated from the circuit.

In some embodiments, the sequencer operates on a predetermined switching sequence to sequentially isolate and connect individual LEDs to the circuit. A driving signal provided on the leads may then control each of the LEDs in the order determined by the sequencer in some embodiments, when the sequencer advances to the next element of the predetermined sequence is determined by the driver. In a particular embodiment, a synchronization signal is embedded in the driving signal. When the synchronization signal is received, the sequencer advances to the next element of the sequence. In other embodiments, the sequence module 202 operates independently and the driver synchronizes to the sequence module without transmitting control information. For example, each LED may be coupled in series with a resistor, with each resistor having a different resistance. In this example, a driver operating in a constant current mode can determine the sequence and sequence timing of the sequencer 201 and synchronize by monitoring the continuous voltage on the line.

In other embodiments, the sequence module 202 is coupled to a control line 213 to allow control signals to be transmitted to the sequencer 201. For example, a stop/start or restart control signal may comprise a low current signal at a predetermined current level. When the sequencer 201 receives this signal it restarts the sequence, allowing the external driver to synchronize. For example, the low current signal may comprise a current that is insufficient to produce a noticeable illumination level in the LEDs 203. For example, the current level may only produce a luminance between 0 and $10^{-2}$ cd/m$^2$ in the LEDs 203. Accordingly, the control signals embedded in the driving signals may be imperceptible to those viewing the luminaire.

FIG. 3 illustrates a variety of driving currents implemented in accordance with an embodiment of the invention.

Figure 3A:
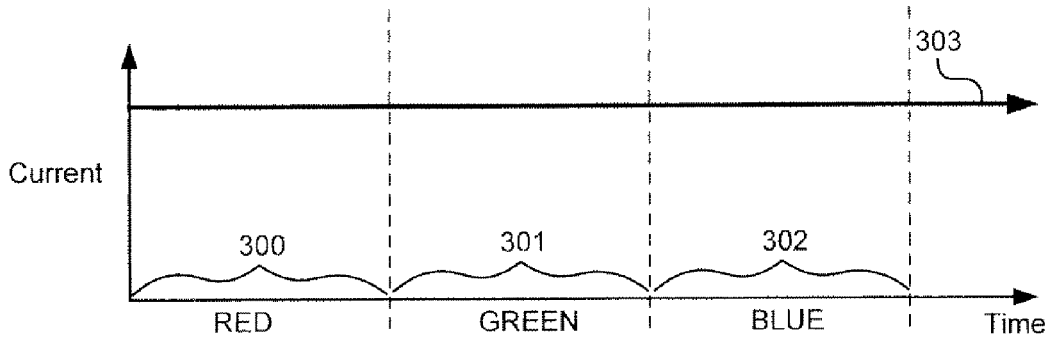
FIG. 3 illustrates a variety of driving currents implemented in accordance with an embodiment of the invention.

FIG. 3A illustrates a constant current driving current 303. As described above, an LED module includes a sequencer that sequentially connects a plurality of LEDs to a circuit. In the illustrated embodiment, the sequencer connects a red LED to the circuit during period 300, a green LED during period 301, and a blue LED during 302, after which the pattern repeats. A constant current signal 303 results in each LED receiving the same amount of current during its respective operating period. Given a sufficiently rapid switching rate, this will appear to a system viewer as a mixed illumination. Of course, to the human eye a mixed sequence it equal intensity red, green, and blue light may not appear as a white or may appear as an non-preferred shade of white. In such embodiments, individual current adjusters or other circuit elements may be coupled to the individual LEDs within the LED luminaire module to modify the respective contributions of the red, green, and blue light. Although this would result in a static light source, it may serve to generate a desired frequency or color of light.

Figure 3B:
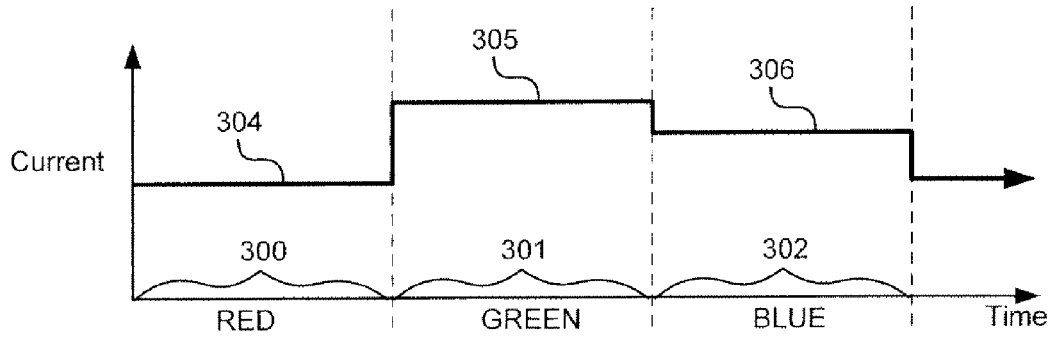

FIG. 3B illustrates a TDM current signal that is configured to provide different current levels to different LEDs. For purposes of illustration, the sequence is again red, green blue, etc. . . . In the illustrated embodiment, the driving signal comprises a red current level 304 transmitted during red period 300, a green current level 305 transmitted during green period 301 and a blue current level 306 transmitted during blue period 302. Accordingly, by individually varying each color's current level, the relative proportion of the red, green, and blue LEDs to the luminaire's illumination may be modified. This allows dynamic generation of different colors and shades of colors. In further embodiments, luminaire dimming may be implemented by reducing total system current while maintaining the relative ratios of each LED's current.

Figure 3C:
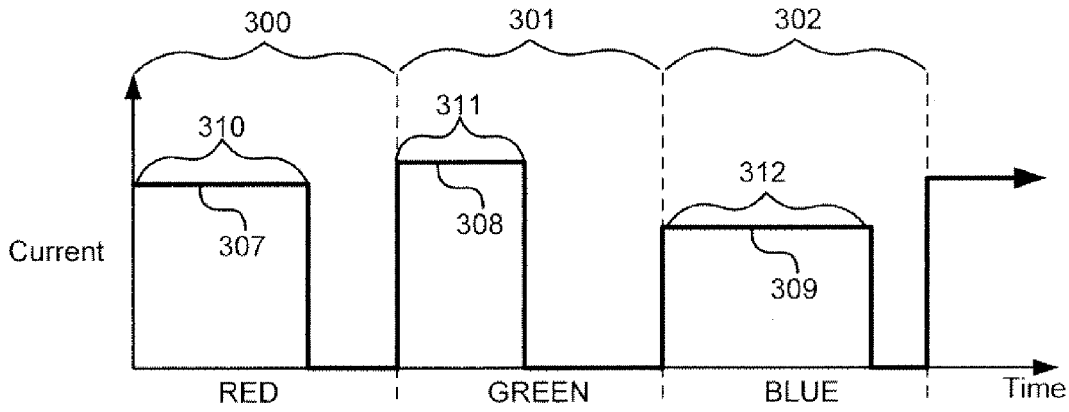

FIG. 3C illustrates a TDM and pulse width modulated (PWM) current signal implemented in accordance with an embodiment of the invention. In addition to modifying the current levels of the driving signal, modification of the pulse widths allows further control of luminaire light output. In the illustrated driving current, the current level 307 drives the red LED for a portion 310 of the red period 300, the current level 308 drives the green LED for a portion 311 of the green period 301, and the current level 309 drives the blue LED for a portion 312 of the blue period 302. The human eye tends to integrate a short light burst over a longer period, making the light appear less bright. Accordingly, the pulse width of each specific. LED current provides a second dimension for modulation in addition to amplification modulation. In some embodiments, PWM may be employed such that each current pulse has an equal width. These equal widths may be modified to dim and brighten the luminaire, as discussed with respect to FIG. 3*d*. In further embodiments, different LEDs may be provided with different pulse widths. This allows modification of the relative contributions of each color LED to the final luminaire light output, allowing for a second level of luminaire color control.

Figure 3D:
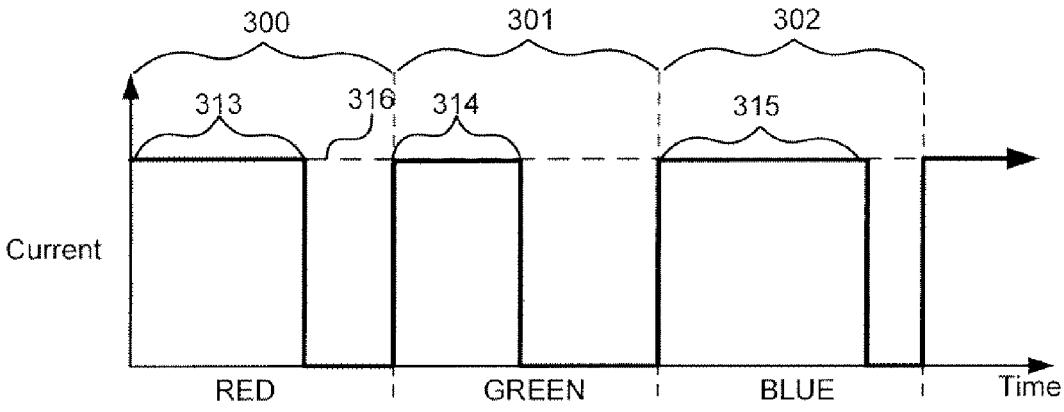

FIG. 3D illustrates a constant current PWM signal implemented in accordance with an embodiment of the invention. In this embodiment, each current pulse has an equal current level 316. Luminaire shade and illumination level is controlled through PWM. In this embodiment, pulse 313 drives the red LED during period 300, pulse 314 drives the green LED during period 301, and pulse 315 drives the blue LET) during period 302. As discussed above, modifying the relative lengths of the pulses modifies the contribution of each LED to the mixed color perceived by the viewer, while modifying the absolute pulse lengths while maintaining the relative pulse length ratios controls dimming.

Figure 4A:
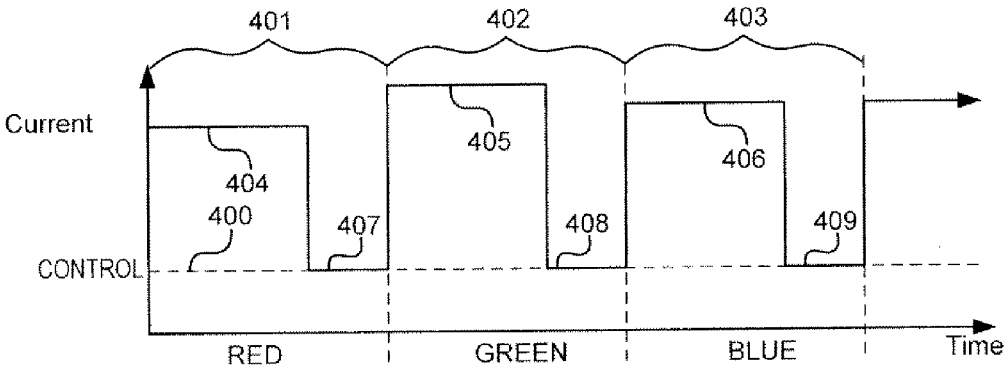
FIG. 4 illustrates driving signals having embedded control signals implemented in accordance with an embodiment of the invention.

FIG. 4 illustrates driving signals having embedded control signals implemented in accordance with an embodiment of the invention. In some embodiments, synchronization between the driving system and the LED luminaire is achieved through synchronization control signals that are embedded in the driving signal. In particular embodiments, the sequencer advances to the next switch in the sequence when it receives a signal transmitted at a control level 400. Accordingly, synchronization between the driver and the sequencer is achieved through the driver's control of the sequencer. In the embodiment illustrated in FIG. 4A, the driving signal drives the red LED during period 401 using driving current 404. Then, the driving signal transmits control current 407, causing the sequencer to advance the switching system to the green LED. During the green LED period 402, the driving current drives the green LED using driving current 405, and then transmits control signal 408 to cause the sequencer to advance the switching system to the blue LED. During the blue LED period 403, the driving signal drives the blue LED with driving current 406, and then transmits control signal 409 to cause the sequencer to advance to the red LED. In the embodiment illustrated in FIG. 4A, different current levels for each of the different LEDs allows color mixing or dimming to be implemented. In further embodiments, PWM may also be implemented to achieve mixing or dimming, as described above.

Figure 4B:
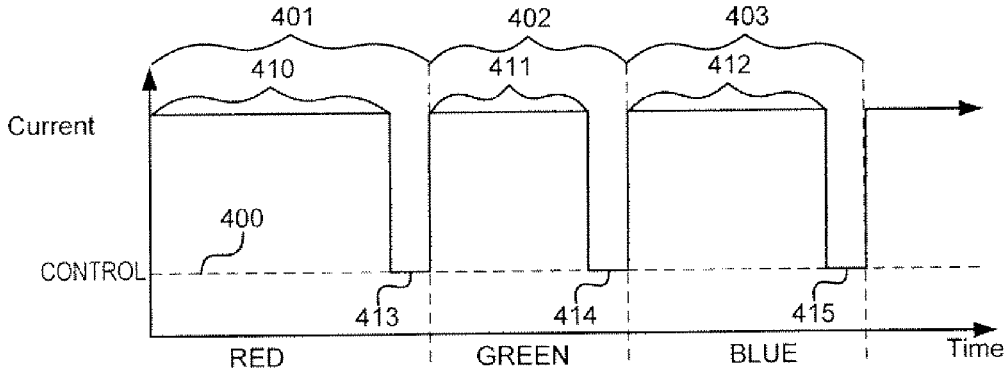

Additionally, in further embodiments, different periods for different LEDs may be different time lengths. FIG. 4B illustrates one such embodiment. In the embodiment in FIG. 4B, red period 401, green period 402, and blue period 403 have different lengths because the timing of the control signals 413, 414, and 415 determines when the sequencer advances to the next LED. Accordingly, the relative lengths of the driving periods 410, 411, and 412 may be modified to allow for modifying the shade of the luminaire. Additionally, PWM may be further implemented to increase the total deactivation time, for dimming purposes.

Figure 5:
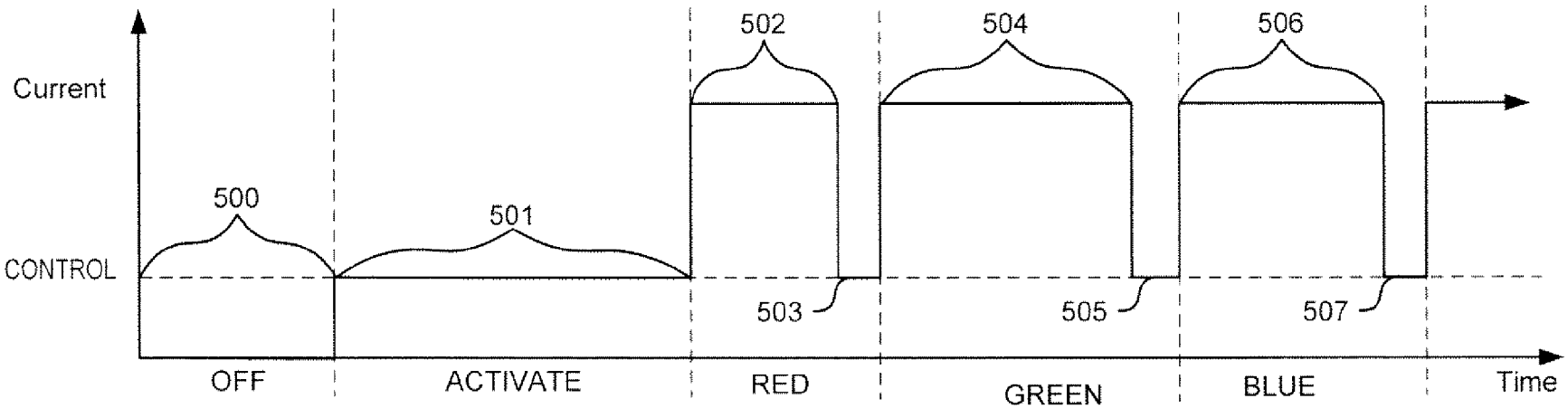
FIG. 5 illustrates a driver signal with embedded control signals implemented in accordance with an embodiment of the invention.

Additionally, embedded control signals may be used to initially activate the sequencer or LED luminaire. FIG. 5 illustrates a driver signal with such control signals. During period 500 the luminaire is deactivated, and no current is transmitted. To activate the luminaire, a control signal is transmitted at the limited control voltage during period 501. In some embodiments, the luminaire module may be configured to respond to a control signal that meets a predetermined duration. In other embodiments, the luminaire module may be configured to respond to an increase in current from the control current. In which case, the luminaire module may stay in a ready state while current is transmitted at control level during activation period 501. After the luminaire module is activated, operation proceeds as described above. When the driver signal current increases, the luminaire begins the predetermined sequence, and connects the red LED to the circuit. Driver current during period 502 drives the red LED. A transition to the control current level 503 triggers the luminaire to connect the green LED. Driver current during period 504 drives the green LED, and transition 505 triggers the precession to the blue LED. Driver current 506 drives the blue LED and transition 507 triggers the sequence to repeat. In the illustrated embodiment, color mixing is achieved through PWM, but as described above, other methods are possible.

Figure 6:
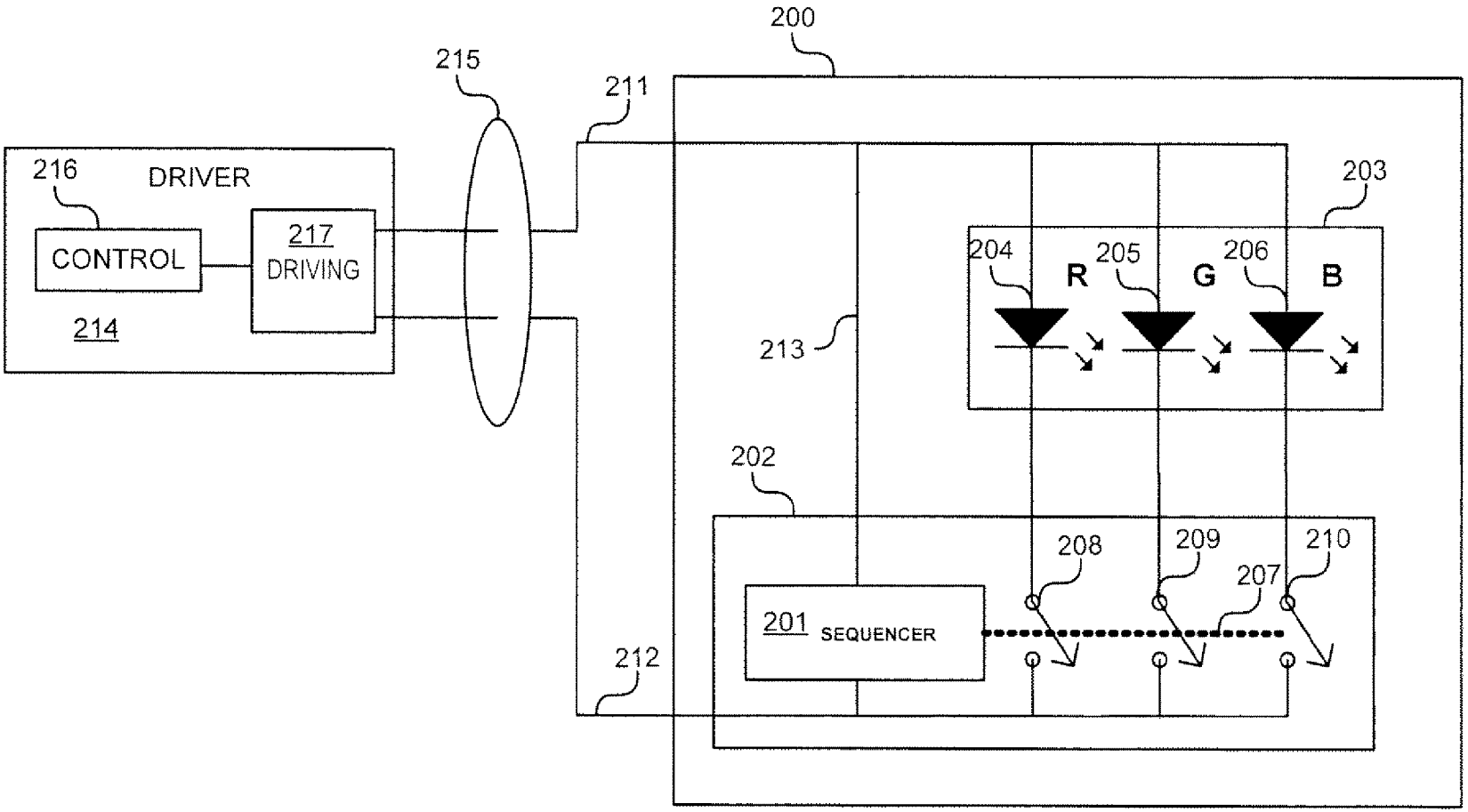
FIG. 6 illustrates a multicolor LED lighting system according to an embodiment of the invention.

FIG. 6 illustrates a multicolor LED lighting system according to an embodiment of the invention. LED module 200 comprises a device substantially as described with respect to FIG. 2. Additionally, a driver 214 is electrically coupled to the LED module 200 using a cable 215. In some embodiments, driver 214 comprises a control module 216 and a driving signal module 217. In response to control signals from control module 216, the driving signal module 217 generates a driving signal to control the operation of the LED module 200. The driver 214 and the sequencer 202 operate in synchronization to allow the single pair of leads 211 and 212 to provide driving signals to all of the plurality of LEDs 203. As described above with respect to FIGS. 3-5, the driving signals may include control signals embedded with the driving signals. These control signals can control this synchronization and may also control the activation of the LED module.

As illustrated, a plurality of LEDs may driven in this manner through the use of only two wires. In addition to substantial materials savings in wires 215, this allows some embodiments to serve in otherwise unsuitable locations. For example, the illustrated system may be particularly suitable for situations involving long wire runs, or situations where only two conductors are available, such as track lighting or lighting upgrades in a vehicle with only two available conductors.

Figure 7:
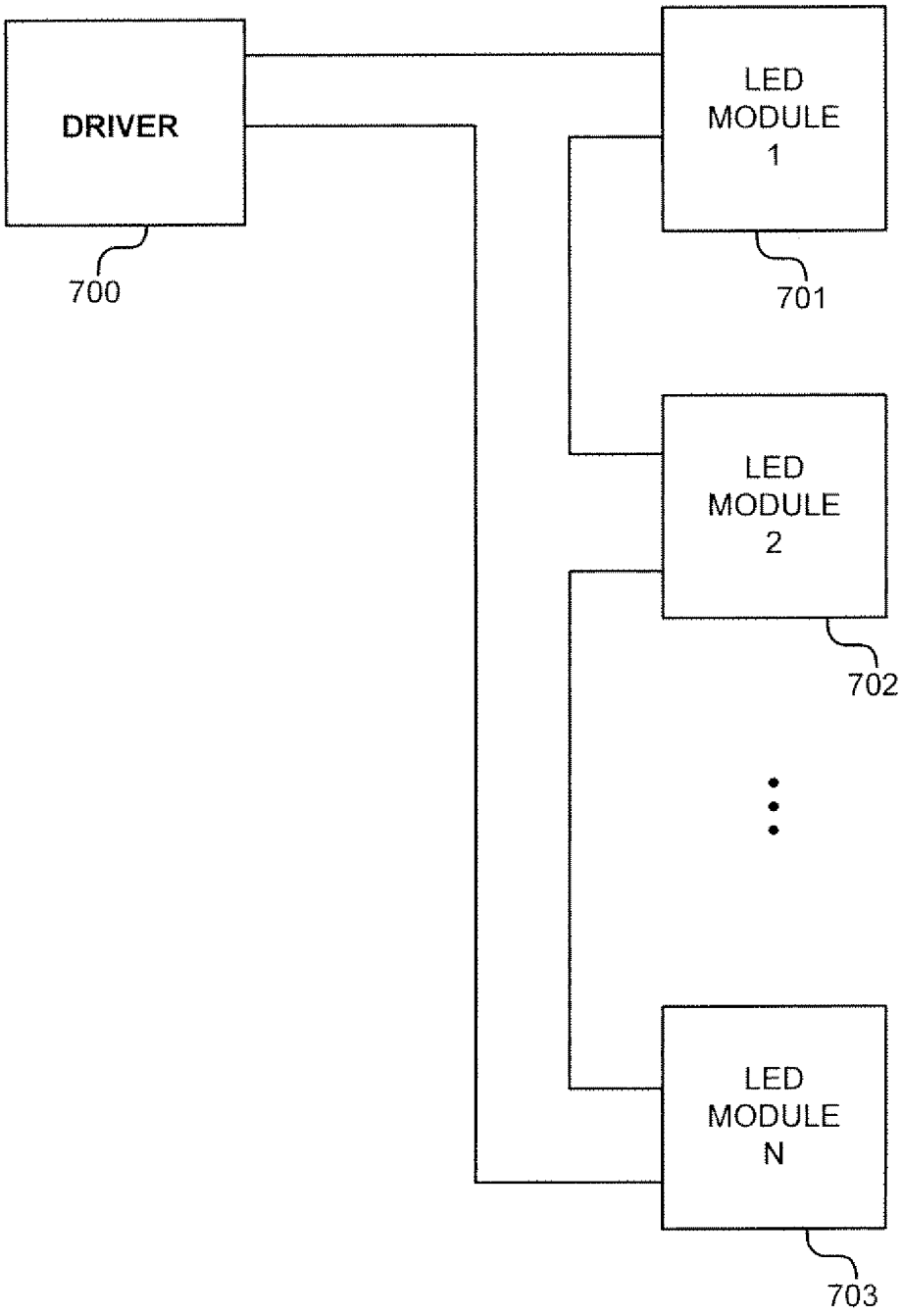
FIG. 7 illustrates a plurality of LED modules driven by a single driver in accordance with an embodiment of the invention.

FIG. 7 illustrates a plurality of LED modules driven by a single driver in accordance with an embodiment of the invention. In the embodiment illustrated in FIG. 7, a plurality of LED modules 701, 702, and 703 are connected in series and driven by a single driver 700. Such configurations may be used to provide a luminaire that covers a large area or a long span. For example, lighted bridge spans, escape lighting within an airplane, and sign back lighting. For these applications, multiple LED modules may be placed in a series circuit with cable runs between the LED modules.

Figure 8:
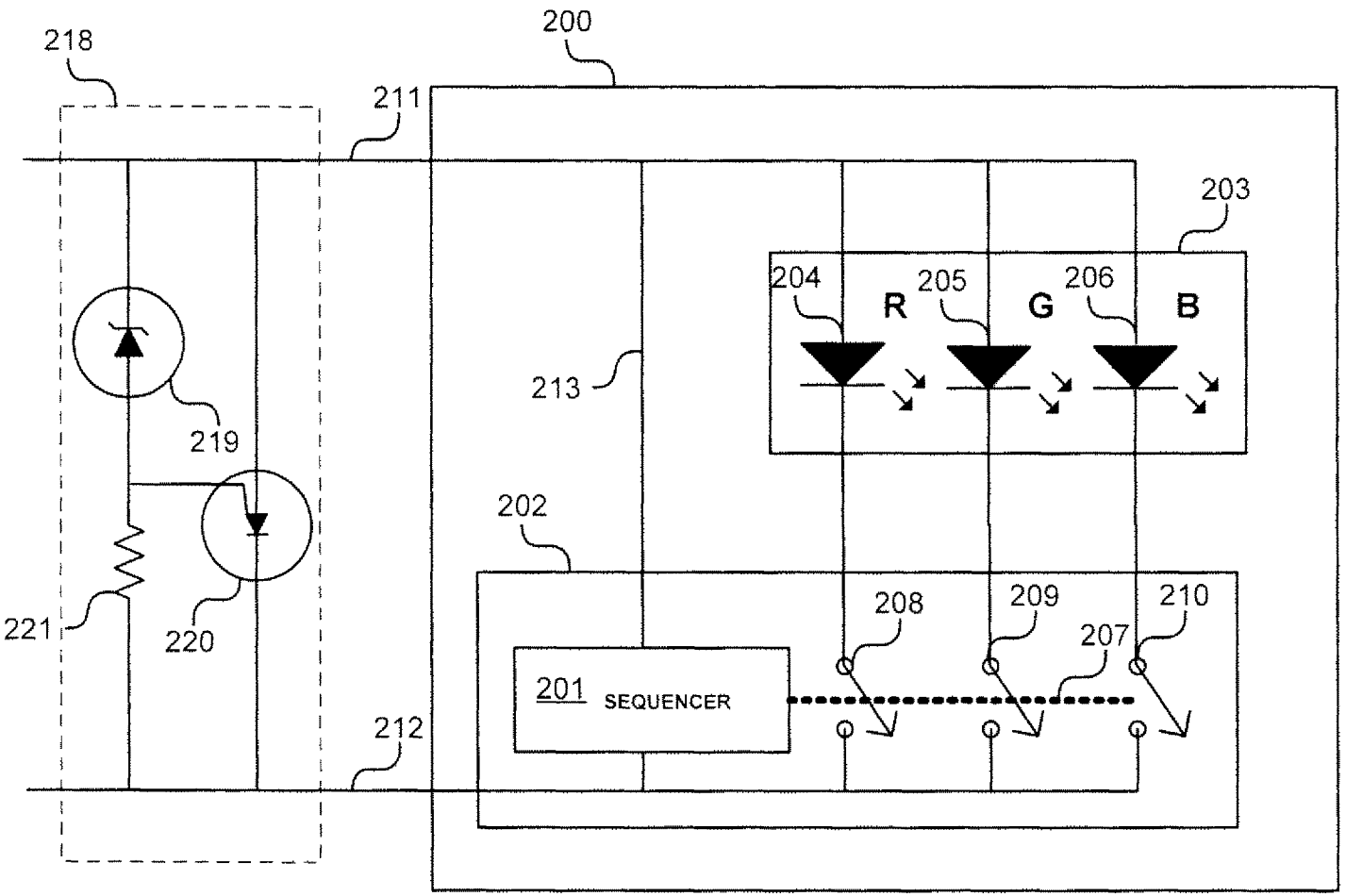
FIG. 8 illustrates an LED module comprising a shunting circuit implemented in accordance with an embodiment of the invention.

When large numbers of LED modules are connected in series with a driver, the failure of any given LED module might prevent the entire chain from operating. Accordingly, in some embodiments, LED modules are coupled to shunt circuits that shunt current around a failed LED module. FIG. 8 illustrates one example of such a shunting circuit. Shunting circuit 218 comprises a zener diode 219, resistor 221, and silicon controlled rectifier 220 in the illustrated configuration. If the LED module 200 fails, current across the shunting circuit rises beyond a predetermined threshold, causing the silicon controlled rectifier to transition into an "on" state, conducting and bypassing the failed LED module 200.

In general, the number of LED modules in series is limited by the available compliance voltage of the driver. In other words, the maximum voltage that the driver can output while maintaining current control. For typical laboratory drivers, this limit is 100-200V. With typical LEDs and circuit components, this corresponds to 20-40 LED modules.

Figure 9:
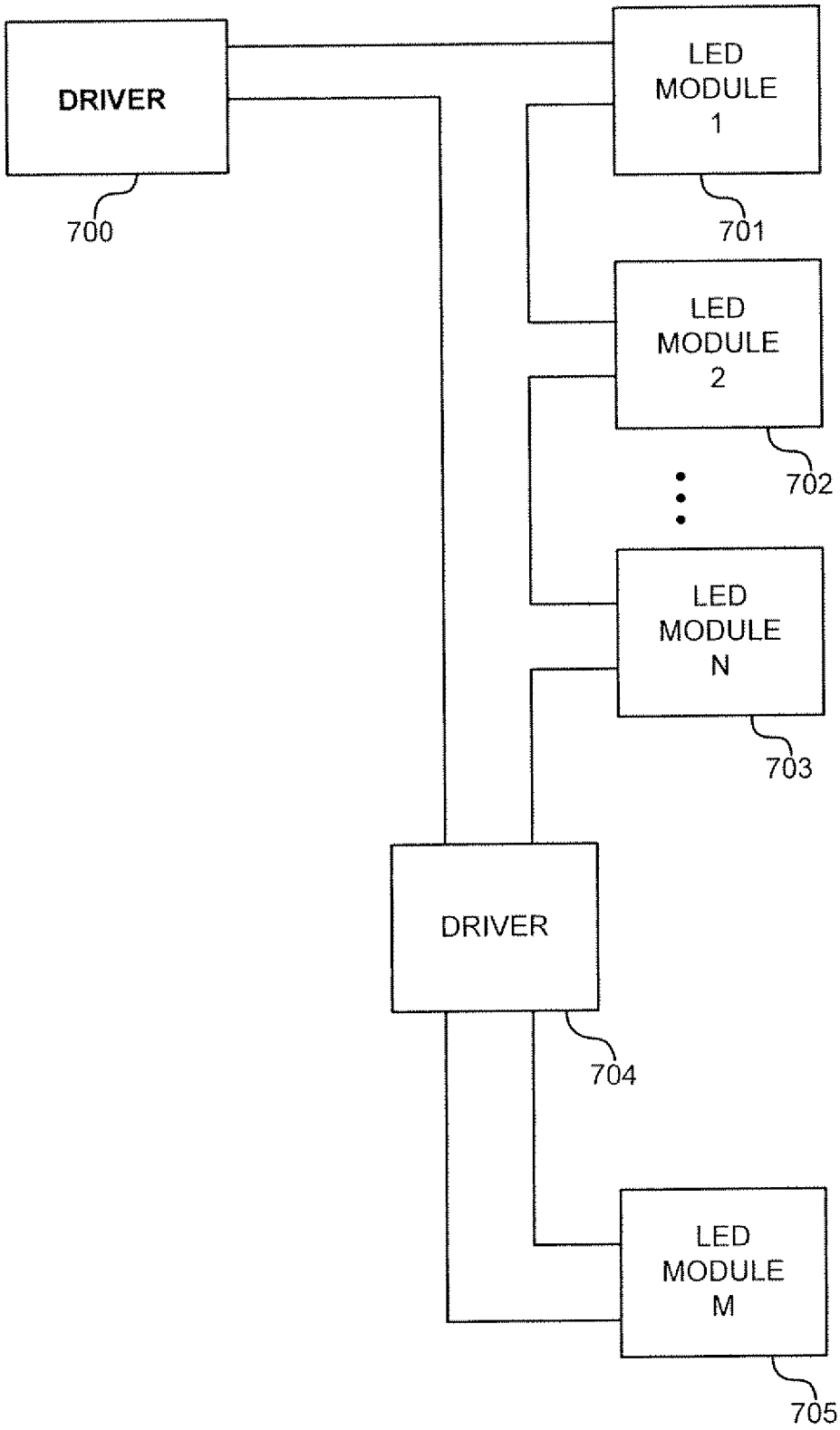
FIG. 9 illustrates a circuit having repeating LED drivers implemented in accordance with an embodiment of the invention.

To allow for longer chains of LED modules, repeating drivers may be implemented. Because control signals are transmitted within the driving signals themselves, repeating drivers may be connected to the same circuits without the use of separate control or signaling cables. A repeating driver is configured to sense the driving signal and retransmit it to allow for an increased number of LED modules within the circuit. FIG. 9 illustrates such a configuration. Driver 704 is configured to sense the driving signal originally transmitted by driver 700 and to retransmit it on the circuit to allow for an increased number of LED modules 705.

In some embodiments, analog driving signals may be employed, and a repeating LED driver may be configured to retransmit the analog driving signal as it senses the signal. However, in some applications, imperfections in signal reproduction can degrade the quality of the signal, and consequently impact the quality of the light produced by the luminaire. In these embodiments, a TDM modulation scheme is employed that uses discrete current levels and discrete LED period durations. A downstream repeating driver then senses a transmitted driving signal and repeats the closest discrete signal to the received signal. Accordingly, normal signal degradation does not impact the quality of downstream light, because the retransmitted signal is equivalent to the original driving signal. In this configuration, the overall error for any arbitrary length chain of drivers is equal to the error of one driver.

Figure 10:
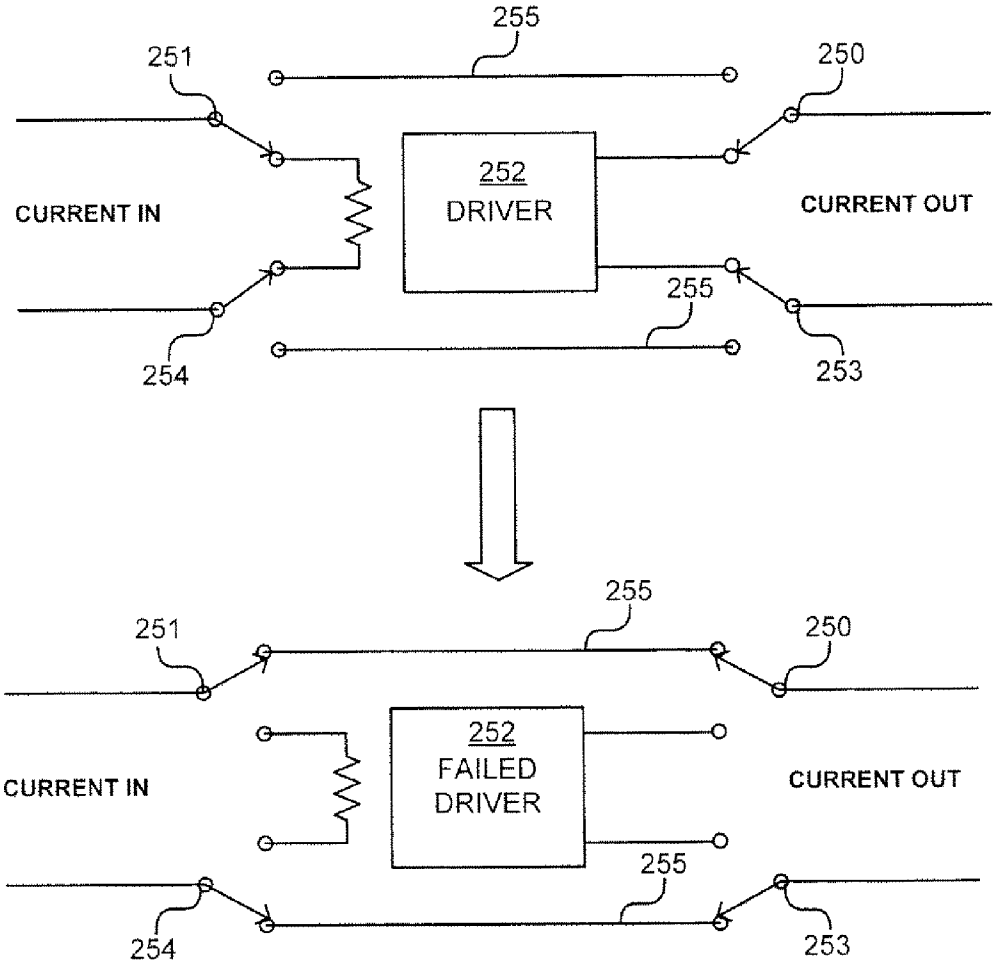
FIG. 10 illustrates a shunting system for a redundant repeating driver circuit implemented in accordance with an embodiment of the invention.

In some embodiments, repeating drivers may be provided with redundant fault protection. FIG. 10 illustrates a shunting system that may be used to provide such protection in accordance with an embodiment of the invention. In this embodiment, a plurality of relays are coupled to the circuit to switch between a driver 252 and a bypass line 255. As illustrated, when a driver fails, the relays switch to the bypass line, allowing upstream drivers to provide the driving signal to LED modules previously driven by the failed driver. In a particular embodiment, the relays are configured so that they are in their energized state when coupled to the driver and in their de-energized state when coupled to the bypass line 255. Accordingly, when the relays are de-energized, for example through a local power failure that would also cause the driver 252 to fail, then the relays automatically enter the bypassed state. In some embodiments, each driver in a multi-driver system is able to power more than double the normal compliance voltage of the connected LED modules. In addition to improving long-term reliability this de-rated operating point allows any given driver of the plurality of drivers to fail without interrupting luminaire operation.

Figure 11:
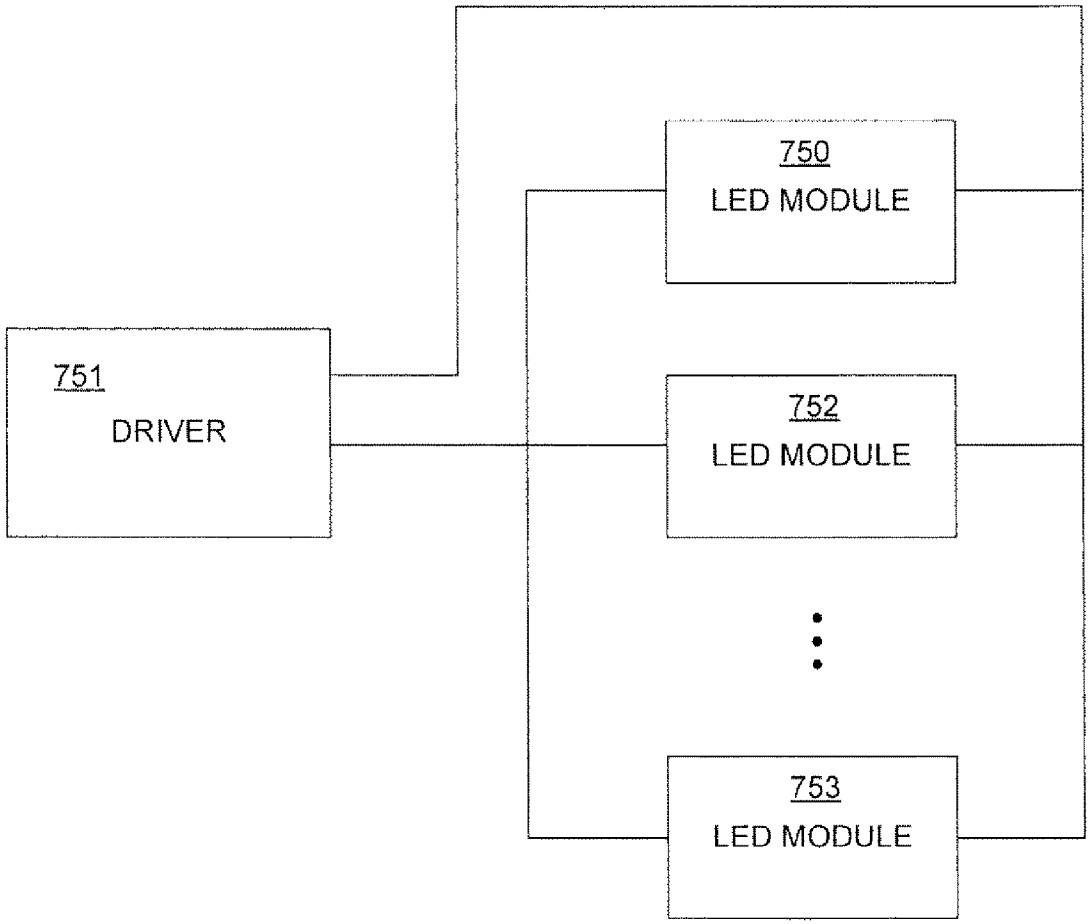
FIG. 11 illustrates a parallel circuit configuration for a plurality of LED modules implemented in accordance with an embodiment of the invention.

In addition to series circuits of multiple LED modules, some embodiments of the invention may provide for multiple LED modules in parallel. FIG. 11 illustrates such a configuration where a plurality of LED modules 750, 752, and 753 are connected in parallel to driver 751. In this mode of operation, the driver 751 is configured to operate in a constant voltage mode, rather than a constant current mode. To support this mode of operation, LED modules 750, 752, and 753 further comprise internal current control devices, such as positive temperature coefficient resistors (PTCs). However, because the current to the LED modules is fixed by the PTCs, the driver 751 cannot modify the current provided to the LED modules and PWM must be used for brightness control and color mixing. These parallel configurations have particular usefulness in applications such as overhead track or open conductor cable lighting that have only two conductors available.

As used herein, the term module might describe a given unit of functionality that can be performed in accordance with one or more embodiments of the present invention. As used herein, a module might be implemented utilizing any form of hardware, software, or a combination thereof. For example, one or more processors, controllers. ASICs. PLAs, PALs, CPLDs. FPGAs, logical components, software routines, circuit elements, or other mechanisms might be used in a module. In implementation, the various modules described herein might be implemented as discrete modules or the functions and features described can be shared in part or in total among one or more modules. In other words, as would be apparent to one of ordinary skill in the art after reading this description, the various features and functionality described herein may be implemented in any given application and can be implemented in one or more separate or shared modules in various combinations and permutations. Even though various features or elements of functionality may be individually described or claimed as separate modules, one of ordinary skill in the art will understand that these features and functionality can be shared among one or more common software and hardware elements, and such description shall not require or imply that separate hardware or software components are used to implement such features or functionality.

While various embodiments of the present invention have been described above, it should be understood that they have been presented by way of example only, and not of limitation. Likewise, the various diagrams may depict an example architectural or other configuration for the invention, which is done to aid in understanding the features and functionality that can be included in the invention. The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the present invention. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one more of the other embodiments of the invention, whether or not such embodiments are described and whether or not such features are presented as being a part of a described embodiment. Thus, the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed in multiple groupings or packages or across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

The invention claimed is:

1. A multicolor light emitting diode (LED) lighting system, comprising:

an LED module comprising a plurality of LEDs, and a sequencer electrically coupled to the plurality of LEDs configured to connect LEDs of the plurality to a circuit and isolate other LEDs of the plurality from the circuit in a predetermined sequence;

a driver electrically coupled to the circuit and configured to provide a driving signal to the plurality of LEDs according to the predetermined sequence and in synchronization with the sequencer; and a second LED module and a second driver, the second LED module and second driver electrically coupled to the circuit, wherein the second driver is configured to repeat the driving signal and provide the repeated driving signal to the second LED module;

wherein the driving signal comprises a plurality of driving pulses ordered according to the predetermined sequence, a driving pulse of the plurality configured to cause the LED connected to the circuit to illuminate.

2. The system of claim 1, wherein, during a period of the sequence, the sequencer connects a single LED of the plurality to the circuit and isolates the remaining LEDs of the plurality from the circuit.

3. The system of claim 1, wherein the sequencer is configured to respond to a synchronization signal embedded within the driving signal.

4. The system of claim 3, wherein the synchronization signal is configured restart the predetermined sequence.

5. The system of claim 3, wherein the synchronization signal is configured to cause the sequencer to advance to the next element of the predetermined sequence.

6. The system of claim 3, wherein the synchronization signal is transmitted at a current level sufficient to cause an LED of the plurality to produce a luminance between 0 to $10^{-2}$ cd/m$^2$.

7. The system of claim 1, wherein the driver is configured to vary an intensity of illumination of a given LED of the plurality by varying a pulse-width of a driving pulse corresponding to the given LED.

8. The system of claim 1, wherein the LED module comprises a current control device, and wherein the driver operates in a constant voltage mode.

9. The system of claim 1, wherein the driver is configured such that current levels of the driving pulses or pulse-widths of the driving pulses are variable.

10. The system of claim 1, wherein the plurality of driving pulses have current levels selected from a predetermined plurality of current levels, and wherein the second driver is configured to perform the step of repeating the driving signal for a given driving pulse by determining which current level of the predetermined current level was originally transmitted by the first driver and transmitting a repeat driving signal having the originally transmitted current level.

11. The system of claim 1, further comprising a bypass system electrically coupled to the second driver and configured to isolate the second driver from the circuit if the second driver fails such that the second LED module is illuminated by the first driver.

12. A multicolor light emitting diode (LED) lighting system, comprising:

an LED module comprising a of LEDs, and a sequencer electrically coupled to the plurality of LEDs configured to connect LEDs of the plurality to a circuit and isolate other LEDs of the plurality from the circuit in a predetermined sequence; and a driver electrically coupled to the circuit and configured to provide a driving signal to the plurality of LEDs according to the predetermined sequence and in synchronization with the sequencer;

a second LED module connected to the circuit in series with the first LED module; and a shunting circuit electrically coupled to the second LED module configured to shunt current around the second LED module if the current across the second LED module exceeds a predetermined threshold.

13. An LED driving device, comprising:

a control module; and a driving module coupled to the control module;

wherein the control module is configured to cause the driving module to provide a driving signal to an LED module in synchronization with a sequencer in the LED module to cause a plurality of LEDs in the LED module to illuminate in a predetermined sequence;

wherein the plurality of driving pulses have current levels selected from a predetermined plurality of current levels;

wherein the control module is configured to receive a driving signal transmitted by a second LED driving device; and wherein the control module is configured to repeat the received driving signal by determining which current level of the predetermined current level was originally transmitted by the second LED driving device and causing the driver module to transmit a repeat driving signal having the originally transmitted current level.

14. The device of claim 13, wherein the control module is further configured to cause the driving module to provide a synchronization signal embedded within the driving signal to the sequencer.

15. The device of claim 14, wherein the synchronization signal is configured to cause the sequencer to advance to the next element of the predetermined sequence.

16. The device of claim 14, wherein the synchronization signal is configured restart the predetermined sequence.

17. The device of claim 14, wherein the synchronization signal is transmitted at a current level sufficient to cause an LED of the plurality to produce a luminance between 0 to $10^{-2}$ cd/m$^2$.

18. The device of claim 13, wherein the driving signal comprises a plurality of driving pulses ordered according to the predetermined sequence, a driving pulse of the plurality configured to cause an LED connected to a circuit to illuminate.

19. The device of claim 18, wherein the control module is configured such that current levels of the driving pulses or pulse-widths of the driving pulses are variable.

20. The system of claim 12, wherein, during a period of the sequence, the sequencer connects a single LED of the plurality to the circuit and isolates the remaining LEDs of the plurality from the circuit.

21. The system of claim 12, wherein the sequencer is configured to respond to a synchronization signal embedded within the driving signal.

22. The system of claim 12, wherein the driving signal comprises a plurality of driving pulses ordered according to the predetermined sequence, a driving pulse of the plurality configured to cause the LED connected to the circuit to illuminate.

23. The system of claim 22, further comprising a second LED module and a second driver, the second LED module and second driver electrically coupled to the circuit, wherein the second driver is configured to repeat the driving signal and provide the repeated driving signal to the second LED module.

24. A multicolor light emitting diode (LED) lighting system, comprising:

an LED module comprising a plurality of LEDs, and a sequencer electrically coupled to the plurality of LEDs configured to connect LEDs of the plurality to a circuit and isolate other LEDs of the plurality from the circuit in a predetermined sequence;

a driver electrically coupled to the circuit and configured to provide a driving signal to the plurality of LEDs according to the predetermined sequence and in synchronization with the sequencer; and a second LED module and a second driver, the second LED module and second driver electrically coupled to the circuit, wherein the second driver is configured to repeat the driving signal and provide the repeated driving signal to the second LED module.

25. The system of claim 24, wherein the plurality of driving pulses have current levels selected from a predetermined plurality of current levels, and wherein the second driver is configured to perform the step of repeating the driving signal for a given driving pulse by determining which current level of the predetermined current level was originally transmitted by the first driver and transmitting a repeat driving signal having the originally transmitted current level.

26. The system of claim 24, further comprising a bypass system electrically coupled to the second driver and configured to isolate the second driver from the circuit if the second driver fails such that the second LED module is illuminated by the first driver.

* * * * *